US005300969A

United States Patent [19]

Miura et al.

[11] Patent Number: 5,300,969

[45] Date of Patent: Apr. 5, 1994

[54] INK JET RECORDING METHOD AND APPARATUS FOR MAINTAINING EFFICIENT INK VISCOSITY

[75] Inventors: Yasushi Miura, Kawasaki; Hisashi Fukushima; Haruhiko Moriguchi, both of Yokohama, all of Japan

[73] Assignee: Canon Kabushiki Kaisha, Tokyo, Japan

[21] Appl. No.: 980,101

[22] Filed: Nov. 23, 1992

Related U.S. Application Data

[63] Continuation of Ser. No. 649,731, Feb. 1, 1991, abandoned.

[30] Foreign Application Priority Data

Feb. 2, 1990 [JP] Japan ..... 2-22183

[51] Int. Cl.[5] ..... B41J 2/05

[52] U.S. Cl. ..... 346/1.1; 346/140 R

[58] Field of Search ..... 346/1.1, 140 R, 76 PH

[56] References Cited

U.S. PATENT DOCUMENTS

| | | | |
|---|---|---|---|
| 4,313,124 | 1/1982 | Hara . | |
| 4,345,262 | 8/1982 | Shirato et al. | 346/140 R |
| 4,459,600 | 7/1984 | Sato et al. . | |
| 4,463,359 | 7/1984 | Ayata et al. . | |
| 4,536,774 | 8/1985 | Inui | 346/76 PH |
| 4,558,333 | 12/1985 | Sugitani et al. . | |
| 4,567,488 | 1/1986 | Moriguchi et al. | 355/76 PH |
| 4,712,172 | 12/1987 | Kiyohara | 346/140 X |
| 4,723,129 | 2/1988 | Endo et al. | 346/1.1 |
| 4,740,796 | 4/1988 | Endo et al. . | |
| 4,791,435 | 12/1988 | Smith | 346/140 X |
| 4,806,950 | 2/1989 | Sekine | 346/76 PH |
| 4,982,199 | 1/1991 | Dunn | 346/140 R X |
| 5,006,867 | 4/1991 | Koizumi et al. | 346/140 R |

FOREIGN PATENT DOCUMENTS

| | | |
|---|---|---|
| 0300634 | 1/1989 | European Pat. Off. . |
| 3839089 | 6/1989 | Fed. Rep. of Germany . |
| 54-56847 | 5/1979 | Japan . |
| 60-248357 | 5/1984 | Japan . |
| 59-123670 | 7/1984 | Japan . |
| 59-138461 | 8/1984 | Japan . |
| 60-71260 | 4/1985 | Japan . |
| 61-239966 | 10/1986 | Japan . |
| 2212691 | 7/1989 | United Kingdom . |
| 2220892 | 1/1990 | United Kingdom . |

*Primary Examiner*—Joseph W. Hartary

*Attorney, Agent, or Firm*—Fitzpatrick, Cella, Harper & Scinto

[57] ABSTRACT

A recording apparatus includes an ink jet recording head having plural ejection outlets and thermal energy generating elements provided for the respective ejection outlets; a signal supplying device for supplying a recording signal to said recording head; a detector for detecting a state relating to heat, on the basis of the recording signal supplied from the signal supplying device; and a controller, responsive to the detector, for actuating the thermal energy generating element. The apparatus maintains the viscosity of the ink in the recording head lower than a critical ejection viscosity.

31 Claims, 7 Drawing Sheets

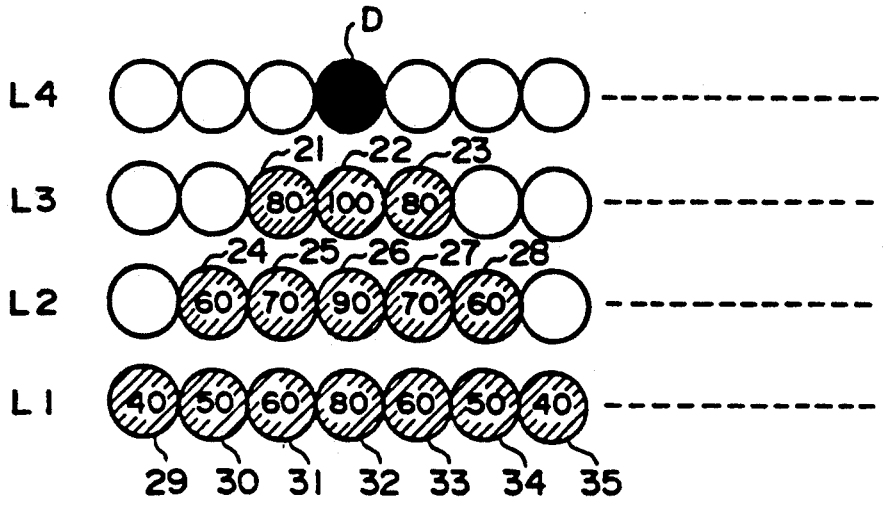
FIG. 4
FIG. 5(a)
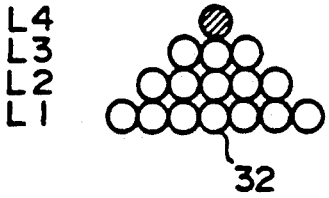
X = 0
FIG. 5(b)
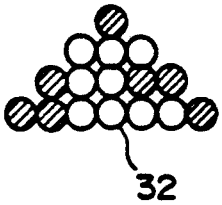
X = 320
$X_{PH}$ = 330
FIG. 5(c)
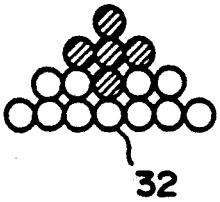
X = 350
FIG. 5(d)
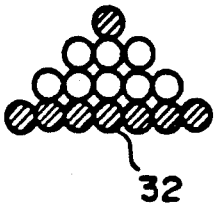
X = 380

INK JET RECORDING METHOD AND APPARATUS FOR MAINTAINING EFFICIENT INK VISCOSITY

This application is a continuation of application Ser. No. 07/649,731 filed Feb. 1, 1991, abandoned.

FIELD OF THE INVENTION AND RELATED ART

The present invention relates to an ink jet recording apparatus and method using a recording head wherein liquid is ejected or discharged using thermal energy.

A liquid jet recording method includes ejecting or discharging a droplet of recording liquid through one of various processes, onto a recording material such as paper to effect recording.

Among the machines using the recording methods, a liquid jet recording apparatus of a type using thermal energy for the formation of the droplet of the liquid, which is advantageous from the standpoint of high density of the ejection outlets.

Such a liquid jet recording apparatus using the thermal energy as the liquid droplet ejecting energy, comprises liquid droplet formation means for forming a droplet of the recording liquid by heating the recording liquid, thus causing a state change of the liquid resulting in an instantaneous volume increase to eject the liquid through an ejection outlet, and an electrothermal transducer (heater) responsive to an electric signal to produce heat to heat the recording liquid. The droplet formation means and the electrothermal transducer are included in a recording head.

The recording liquid used in the liquid ejection recording apparatus, usually mainly contains water from the standpoint of proper recording properties and safety or the like. Such a recording liquid contains a recording material such as pigment or dye and a solvent for dispersing or dissolving the recording material, the solvent containing mainly water or water and water-soluble organic solvent.

In a recording apparatus using heat as the liquid ejection energy and in a recording apparatus of another liquid droplet formation type, the ejection outlet is often exposed to the ambience irrespective of drive thereof.

When the recording operation is uneffected for a long period of time, and particularly when the recording liquid is of a water-base type, the solvent such as the water and the volatile organic solvent evaporates from the recording liquid through the ejection outlet, with the result that the recording material and the solvent component which is not easily evaporated remains in the recording liquid. Then, the viscosity of the recording liquid containing the remainder increases, possibly to the extent that the viscosity exceeds the preferable range for the ejection of the recording liquid. Therefore, immediately after the resumption of the recording operation, ejection failure tends to occur, that is, the liquid is not ejected despite the application of the ejection signal. If this occurs, the recorded image involves defects at the portion where the initial recording is effected after the resumption.

When the temperature is low, the viscosity of the recording liquid increases with the tendency of similar improper ejection or ejection failure.

In order to avoid the problems arising from the existence of the non-recording period or the variation in the ambient conditions, Japanese Laid-Open Patent Application No. 248,357/1985, for example, has made a proposal, in which in order to maintain the temperature of the recording liquid within a predetermined range, the heater is supplied with electric energy, immediately before the start of the printing, the electric power having such a level that the recording liquid is not ejected. By doing so, the printing operation is performed with stability because the recording liquid is heated. Depending on the presence or absence of the recording signal, the preliminary heating is controlled.

On the other hand, the printing is disturbed in some case even if the recording operation is continued. Particularly when the recording head is a multi-nozzle head having a plurality of recording elements arranged along one line, or a full-color multi-nozzle head having a plurality of such multi-nozzle heads, corresponding to the number of colors, the disturbances in the printed image density or in the printed color, relatively frequently occur.

The causes of them will be different from the above-described problems, and is considered as being related with the relative relation among recording elements occurring in the execution of the printing.

When such a pattern as results in non-printing state in a part of the multi-nozzle head, the increase in the viscosity of the recording liquid occurs due to the evaporation of the water content and the decrease of the recording liquid temperature at the ejection outlet or outlets corresponding to the non-recording part. The improper ejection may occur even during one line recording operation.

The temperature of the actuated ejection outlet or outlets is further increased by the thermal energy produced by the actuation, and therefore, a greater temperature difference results between the non-actuated portion and the actuated portion (ejection outlets). This results in a large viscosity difference therebetween, with the result of ejection performance difference in the diameter of the ejected droplet and in the ejection speed or the like. This is one of the causes of the image quality degradation.

U.S. Ser. No. 383,098 which was abandoned in favor of U.S. Ser. No. 566,885 and has been assigned to the assignee of this application and, U.S. Ser. No. 518,238, which matured into U.S. Pat. No. 5,006,867 and has been assigned to the assignee of this application, have proposed in order to solve the problem of the improper ejection attributable to the temperature distribution described above, that a temperature sensor for detecting the temperature of the recording head is provided in the recording head, and the head temperature is controlled on the basis of the detected temperature.

SUMMARY OF THE INVENTION

Accordingly, it is a principal object of the present invention to provide a liquid jet recording apparatus wherein the image quality degradation attributable to the improper ejection of the liquid is reduced.

It is another object of the present invention to provide an ink jet recording apparatus wherein the degradation of the image quality attributable to the temperature distribution is prevented without the necessity for the temperature sensor in the recording head.

It is a further object of the present invention to provide a recording apparatus and recording method suitable for use with an ink jet recording head using thermal energy.

According to an aspect of the present invention, there is provided a recording apparatus, comprising: an ink jet recording head having plural ejection outlets and thermal energy generating elements provided for the respective ejection outlets; signal supplying means for supplying a recording signal to said recording head; detecting means for detecting a state relating to heat, on the basis of the recording signal supplied from said signal supplying means; and control means, responsive to said detecting means, for actuating said thermal energy generating element.

According to another aspect of the present invention, there is provided a recording method using an ink jet recording head having plural ejection outlets and thermal energy generating elements provided for the respective ejection outlet, comprising: detecting states of actuations of said thermal energy generating elements for a predetermined period on the basis of record signals supplied to said recording head; effecting preliminary heating by actuation of said thermal energy generating element, when said detecting means detects that the thermal energy generating element is not actuated to a predetermined degree in the predetermined period; and effecting main heating step after said pre-heating step, for actuating the thermal energy generating element to effect recording in accordance with the record signal.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4 illustrates the principle of an accumulation state detection.

FIGS. 5(*a*)–(*d*) illustrate an example of the heat-accumulation state.

DESCRIPTION OF THE PREFERRED EMBODIMENTS

The embodiments of the present invention will be described in detail in conjunction with the accompanying drawings.

Figure 1:
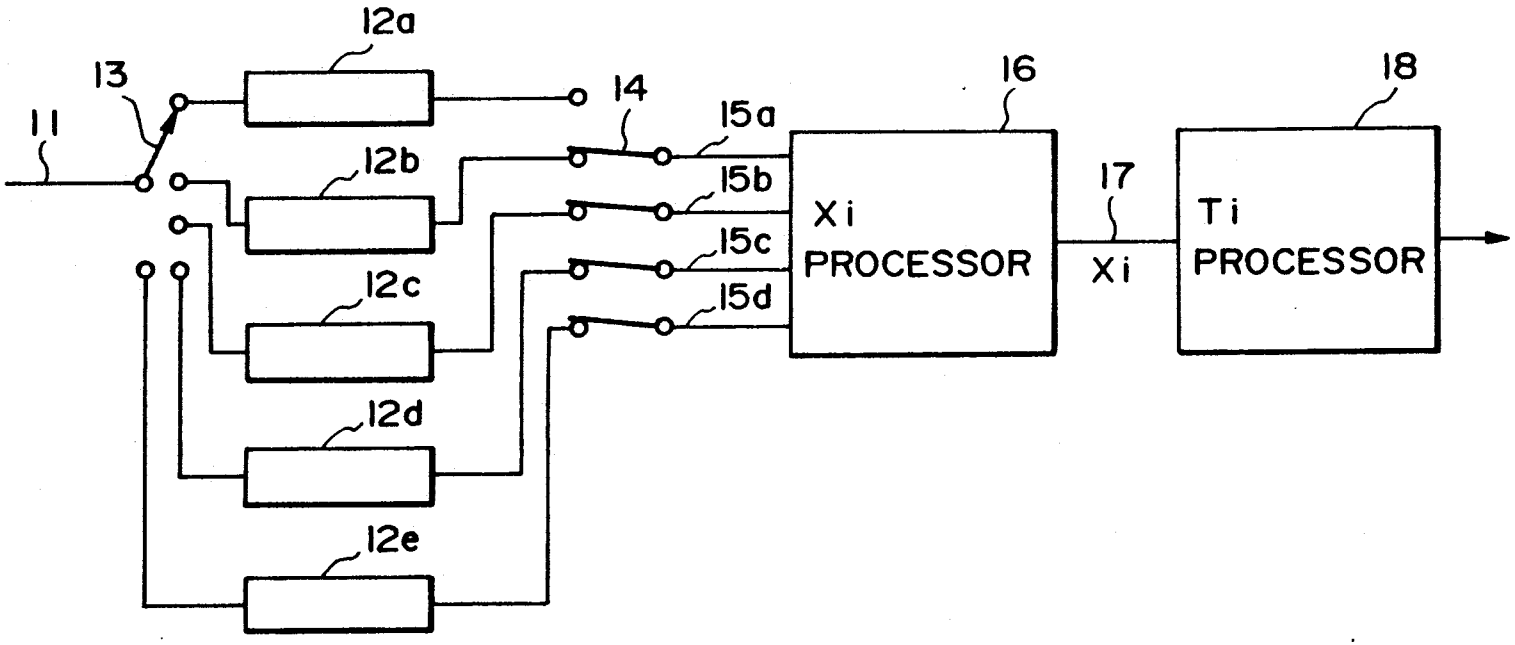
FIG. 1 is a block diagram of a system used in an ink jet recording apparatus according to an embodiment of the present invention.
Figure 2:
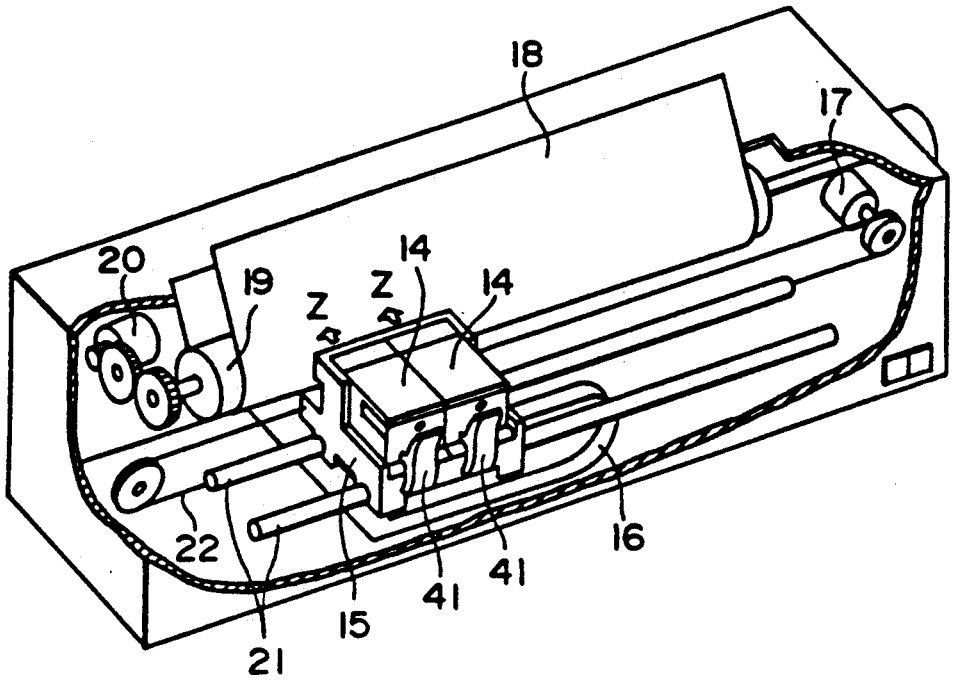
FIG. 2 PRIOR ART
FIG. 2 is a perspective view of a liquid jet recording apparatus according to an embodiment of the present invention.
Figure 3:
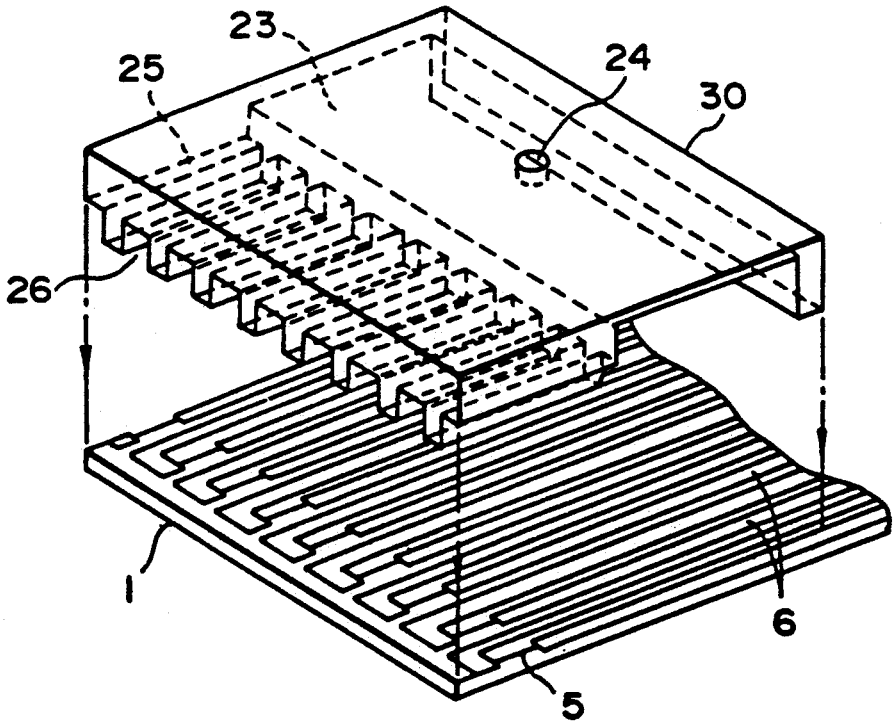
FIG. 3 PRIOR ART
FIG. 3 is a perspective view of a recording head cartridge used in the apparatus of FIG. 2.

FIGS. 1, 2 and 3 are a block diagram of a system used in an ink jet recording apparatus according to the present invention, the structure of the apparatus, and an example of a recording head used therewith, respectively.

Referring to FIG. 2, a recording head cartridge 14 includes as a unit a recording head having a heater board and an ink container as an ink supplying source. The head cartridge 14 is fixed on a carriage 15 by a confining member 41. The carriage 15 is reciprocable together with the cartridge 14 along a shaft 21. The ink ejected through the recording head reaches the recording medium 18 having a recording surface which is confined by a platen 19 with a small clearance from the recording head, so as to form an image on the recording material 18.

The recording head is supplied with ejection signals in accordance with the data representative of the image supplied from a proper data source through a cable 16 and contacts connected thereto. One or more head cartridges may be used in accordance with the color or colors of the ink materials to be used (two are used in the shown example).

Referring to FIG. 2, the carriage 15 is scanningly reciprocated along the shaft 21 by a carriage motor 17 through the wire 22. A feed motor 20 is coupled with the platen roller 19 to feed the recording material 18.

FIG. 3 shows an example of the recording head used in the apparatus of FIG. 2. The recording head comprises a heater board 1 having a silicone substrate, electrothermal transducers (ejection heaters) 5 formed thereon by a film forming process and wiring 6 made of aluminum or the like formed through the same process to supply electric power thereto. A liquid jet recording head is constituted by bonding to the heater board a top plate 30 having partition walls for defining liquid passages 25 for the recording liquid.

The liquid (ink) for the recording is supplied to a common liquid chamber 23 through a supply port 24 formed in the top plate 30, and from the common chamber 23 the ink is supplied to the respective liquid passages 25. When the heater 5 generates heat upon electric power supply, a bubble is formed in the ink filling the liquid passage 29, by which a droplet of the ink is ejected through the ejection outlet 26.

In FIG. 1, line buffers 12*a*–12*d* contain printing data 11 for consecutive lines, respectively. A selector 13 receives a line synchronization signal not shown, and it cyclically switches the contact each time the print data 11 for one line is supplied. When the selector 13 selects the first line buffer 12*a*, as shown in the figure, the print data for the line to be recorded are contained in a fifth line buffer 12*e*. At this time, a fourth line buffer 12*d* contains the data for the preceding line; a third line buffer 12*c* contains the data for the further preceding line; and the second line buffer 12*b* contains the print data for a further preceding line. A selector 14 is disposed at an output side of the line buffers 12*a*–12*e* to select the four line buffers other than the line buffer containing the currently printed data 11. In the state shown in the figure, the print data 11 are written in the first line buffer 12*a*, and therefore, the selector 14 selects the output sides of the other four line buffers 12*b*–12*e*.

Discriminating means in the form of an Xi processor 16 determines state of analyzing heat accumulation of the recording head on the basis of the print data 15*a*–15*d* selected by the selector 14. A Ti processor 18 functions as an electric current supplying means, in which on the basis of an output 17 of the Xi processor, a waveform of the pulse voltage applied to the heater to the individual liquid passages of the recording head is determined. In this embodiment, a liquid passage (nozzle) or passages to be supplied with preliminary heat are determined, using the Xi processor 16.

FIG. 4 illustrates the principle for the determination.

The bottom data line L1 in FIG. 4 represents the data which are going to be recorded. A line L2 immediately thereabove represents the data which are going to be recorded for the next line; a data line L3, the data for the second line; and a data line L4, a third line data.

A datum D (solid black) in the data line L4 (third line), is noted. A predicted heat-accumulation state X for the nozzle corresponding to the data, is expressed:

$$X = \sum_i a_i t_i$$

The data with suffix "i" are the data influential to the temperature of the nozzle corresponding to the noted data D, and more particularly, $t_i$ is quantity of generated heat, and $a_i$ is a temperature coefficient to the noted data.

In this embodiment, data 21–35 (15 in total) influential to the temperature are selected, and the data, among them to be recorded only are weighted (the figures in the data of FIG. 4), and are added, so that the state of heat accumulation corresponding to the data D is predicted.

When the prediction of the heat accumulated state X satisfies $X<X_{PH}$, the preliminary heating pulse is applied to the liquid passage (nozzle) corresponding to the noted data D within the limit not producing bubble.

More particularly, when the $t_i$ processor 18 is supplied with the prediction X satisfying $X<X_{PH}$, the $t_i$ processor 18 produces an output for the preliminary heating pulse signal such that the nozzle corresponding to the data D which is the data in the third line data line L4 after the current line data in line L1 to supply to the heat generating resistor in the nozzle to the extent that the liquid is not ejected, even if the datum corresponding to the datum (datum 32 in FIG. 4) corresponding to the datum D does not represents the necessity for the ejection.

More detailed description will be made using more specific examples.

FIGS. 5(*a*)–(*d*) show the heat accumulation state predictions X in accordance with the weighted data of FIG. 4. In the cases in FIGS. 5(*a*) and (*b*), $X<X_{PH}$ is satisfied, and therefore, the preliminary heating is carried out; and in cases c of FIGS. 5(*c*) and (*d*), $X \geqq X_{PH}$ is satisfied, and therefore, the preliminary heating is not carried out. As will be understood, the heat accumulation state after three more lines printings is predicted on the basis of the print data from the current time to the time corresponding to three lines after. On the basis of the prediction, the preliminary heating is executed at the current time. It will be understood from the data which will be described in the following that the above-described operation is effective.

Figure 6:
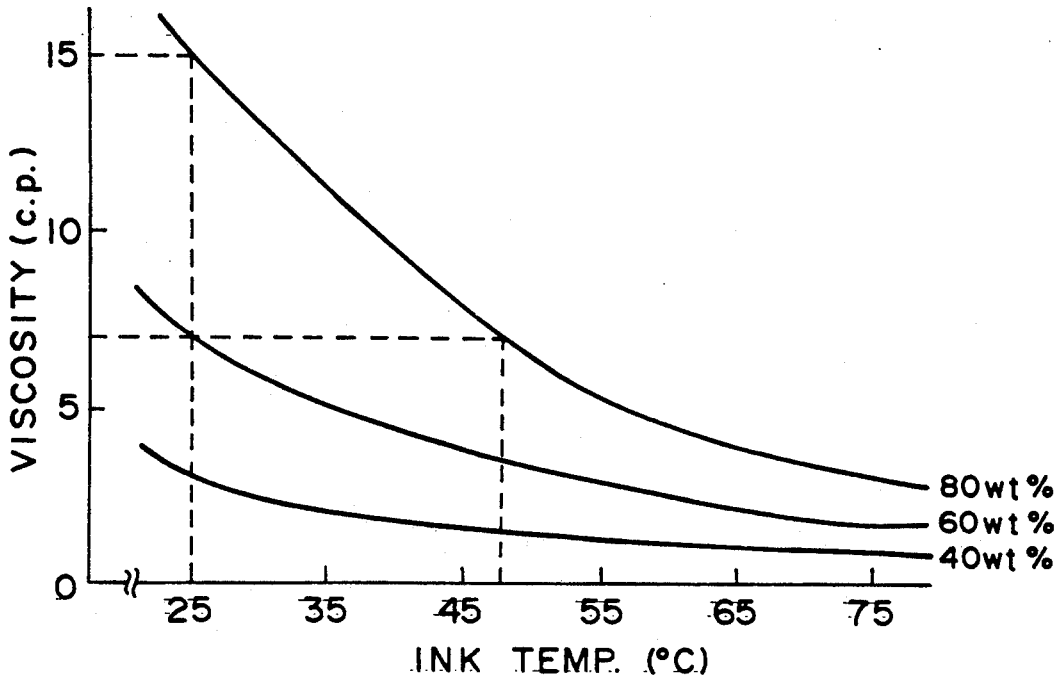
FIG. 6 is a graph showing a relation between an ink temperature and an ink viscosity, in an example.

As shown in FIG. 6, the viscosity of the ink decreases with increase of the temperature. FIG. 6 shows the weight content of diethylene glycol in the ink containing the dye (2%) in diethylene glycol containing water-solvent, at 40%, 60% and 80% by weight. The water content of the ink evaporates with time through the ejection outlets with the result of increase of the diethylene glycol content. Assuming that the liquid passage is capable of ejecting the ink if the viscosity thereof is not more than a critical ejection viscosity, e.g. 7 cp (centipoise), it is capable of ejecting the ink containing not more than 60% by weight of the diethylene glycol at 25° C. If the content thereof becomes 80% by weight due to the water evaporation, it becomes unable to eject the ink with the result of defects in the recorded image. However, if the ink containing 80% by weight of the glycol is heated to approximately 47° C., the viscosity decreases beyond 7 cp, and therefore, the ejection is enabled.

It will be understood that on the basis of the continuous period of the non-print data using detection of the print data, the water content evaporation, and therefore, the glycol weight percentage, can be predicted. On the other hand, as described in the foregoing, the heat accumulation state can be predicted from peripheral data, and therefore, the head temperature (ink temperature) can be predicted. Thus, the discrimination is possible as to what extent the current temperature is to be changed using the curves of FIG. 6, in order to decrease the viscosity of the below the ejection limit viscosity (critical ejection viscosity).

In order to provide further high quality image, the following control may be used.

Figure 7A:
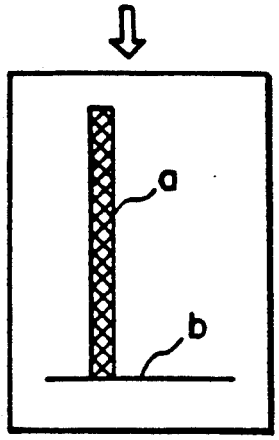
FIGS. 7(A)–(C) illustrate control for providing a high image quality.
Figure 7B:
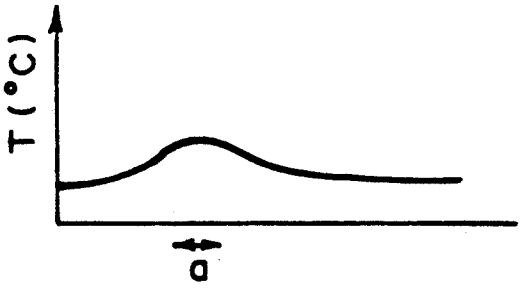
Figure 7C:
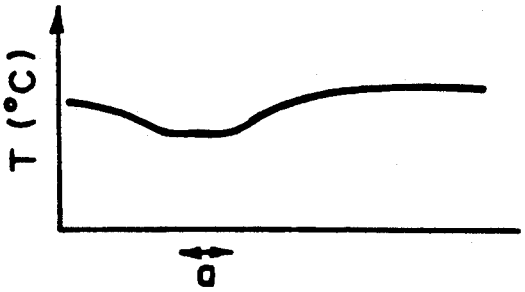

In FIG. 7 (A) shows an image to be recorded. When the recording is effected while carrying out raster scans in the direction indicated by an arrow, the temperature adjacent the nozzle corresponding to a increases in accordance with printing a bar indicated by a. FIG. 7(B) shows the temperature distribution of the heat having plural nozzles, at the point of time at which the line b is recorded. As will be understood, the region a corresponding to the bar has a higher temperature.

Figure 8:
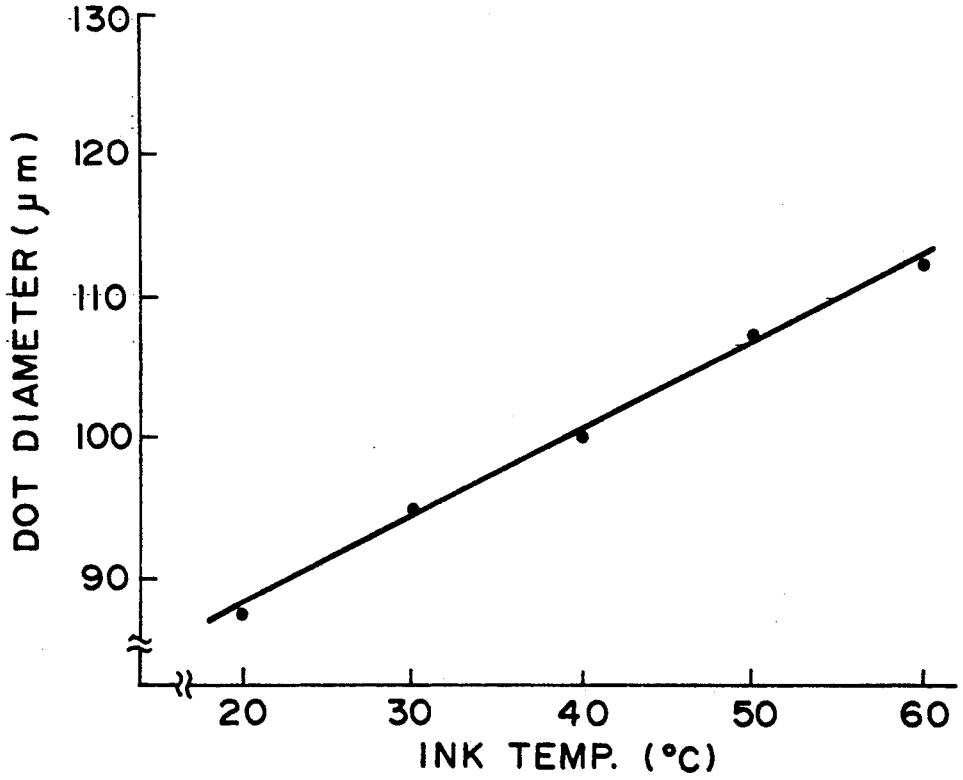
FIG. 8 is a graph showing an example of a relation between a printed dot diameter of and an ink temperature.

FIG. 8 shows a relation between an ink temperature and a print dot diameter. As will be understood from this Figure, the diameter of the print dot is higher if the temperature is higher. This is because the quantity of ejected liquid increases with the decrease of the ink viscosity by the increase of the ink temperature. Therefore, in the case of the temperature distribution shown in FIG. 7(B), the density non-uniformity occurs corresponding to the temperature distribution, even if the ejection is complete. Therefore, it is desirable in order to provide the uniform image density in line b that the temperature distribution shown in FIG. 7(E) is provided. The reason for the non-uniform temperature distribution is that the viscosity of the ink is increased due to the water evaporation in the region other than the region a, and therefore, the printed dot diameter, if any, becomes small, so that the increase of the temperature is desirable for compensation.

The fundamental point of the compensation is to determine the preferable temperature distribution in accordance with the print data, and the preliminary heating is performed so as to provide such a temperature distribution at the proper point of time. Therefore, in the example of FIGS. 7(A)–(C), the preliminary heating is effected immediately before (several seconds before) the line b. The reason for this is that if the preliminary heating is effected at all times, the temperature distribution gradually saturates with the result that the viscosity increases because of the water content evaporation, as described above, and therefore, the preferable distribution is not provided. The tendency is contained beforehand in the processor, and the determinations are made with reference to the print data as to the preliminary heating and the condition such as pulsewidth or the like of the preliminary heating. The preliminary heating is the heating in addition to the recording signal on the basis of the temperature distribution, but if the recording signal is coincident with the preliminary heating signal, the preliminary heating is carried out preceding the recording signal.

Figure 9:
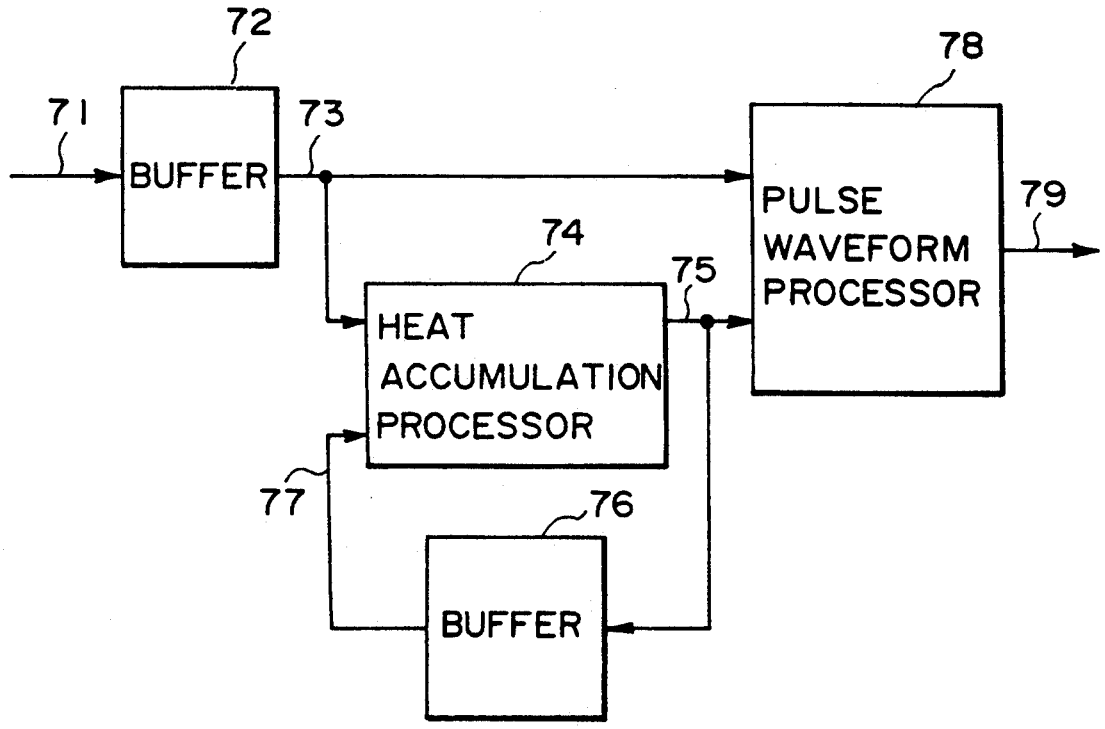
FIG. 9 is a block, diagram of another example of a head driving circuit.

FIG. 9 shows a driving circuit for effecting the above (second embodiment).

The print data 71 are written line-by-line in print data buffers 72 including plural line buffers which are similar to the line buffers 12a–12e of FIG. 1. The written print data are transmitted in synchronism with line synchronization signal, in an accumulation state processor 74 as print data 73 corresponding to plural lines. The results 75 of the processing are transmitted to a buffer 76 for the results of the processing and to a pulse wave processor 78. In this embodiment, the state of heat accumulation is determined on the basis of the print data 73 and the results 77 of the heat accumulation state processing for one line before. A result 79 of the pulse waveform processing is obtained on the basis of the print data 73 and the results 75 of the accumulation state processing.

Referring to FIGS. 10(A)–(E), the description will be made as to a part of change of the pulse waveform for each image by the above-described circuit when an image of FIG. 7(A) is recorded.

As for the nozzle corresponding to a position $a_1$ in the image shown in FIG. 10 (A), a pre-heating pulse is applied to the ejection heater thereof for a predetermined period prior to start of the recording. Subsequently, ejection pulses (driving pulses) having the waveform shown in FIG. 10 (E) are supplied to the corresponding nozzle. The ejection pulses include a sub-heat pulse for the temperature control and a main heating and ejecting pulse with a rest period $t_{off}$ therebetween. Here, the period $t_{off}$ varies, as shown in FIG. 10(B), in accordance with the position shown in FIG. 10(A). By reducing the rest period $t_{off}$ from 6 to 1 micro-sec., the quantity of the ejected ink is corrected to be smaller, thus compensating the tendency for the increase in the ejection quantity of the ink attributable to the increase of the accumulated heat, so that a constant level is maintained. Because of the reduction of the rest period $t_{off}$, the dissipation of the heat resulted by the sub-heating pulse becomes smaller, and therefore, upon the application of the main heating pulse, the temperature rise decreases. Therefore, the correction is toward reduction of the ink ejection quantity. As for the nozzle corresponding to a position b1 in the image of FIG. 10 (A), the pre-heating is effected, as shown in FIG. 10 (D), immediately before the line b of FIG. 10 (A). During the recording, corresponding to the line b, the ejection pulses shown in FIG. 10 (E) are supplied with the rest period $t_{off}$ of 4 micro-sec., as shown in FIG. 10 (C). Here, $t_1=4$ micro-sec., and $t_2=6$ micro-sec. with the waveform shown in FIG. 1 (E).

The voltages of the sub-heating pulse and the main heating pulse are 23 V. Here, the ejection does not occur with the sub-heating pulse alone, but only the temperature increase results.

The pre-heating pulses $a_1$ and $b_1$ have the voltage level of 23 V and the duration of 4 micro-sec. Here, again, the ejection does not occur with the pre-heating pulse alone, but the temperature increase results only.

In the foregoing embodiment, the rest period $t_{off}$ is varied for the control, but the pulse width $t_1$ of the sub-heating pulse may be changed in place thereof. When the sub-heat pulse width $t_1$ is increased, the temperature increase of the ink increases, so that the viscosity of the ink reduces, thus increasing the quantity of ink ejection. As described in the foregoing, according to the present invention, the recording data are detected, and the passage in which the non-recording signal continues is pre-heated to the extent that liquid is not ejected. Therefore, the ejection failure during the recording is eliminated, and the variation in the ejection properties attributable to the temperature difference among the ejection outlets can be corrected, and therefore, good images can be produced.

In the foregoing embodiments, the state of heat accumulation is detected on the basis of the record data, and therefore, the necessity for the temperature sensor for the recording head is eliminated, thus simplifying the structure of the recording head.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency respective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multicolor mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied the present invention is also applicable to other types of ink. In one of them, the temperature rise due to the thermal energy is positively prevented by consuming it for the state change of the ink from the solid state to the liquid state. Another ink material is solidified when it is unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus comprising:

an ink jet recording head having plural ejection outlets for ejecting ink and thermal energy generating elements provided for the respective ejection outlets to apply head to the ink, said thermal energy generating elements being subject to heat accumulation and actuation, the ink being characterized by a viscosity and a critical ejection viscosity;

signal supplying means for supplying a recording signal to said thermal energy generating elements of said recording head;

predicting means for predicting heat accumulation in said thermal energy generating elements, by integration of the recording signals supplied from said signal supplying means; and control means for actuating said thermal energy generating elements having a low predicted heat accumulation to preliminary heat the ink to decrease the viscosity thereof lower than the critical ejection viscosity.

2. An apparatus according to claim 1 for recording plural record lines, wherein said signal supplying means includes line buffer for storing recording signals for the plural record lines.

3. An apparatus according to claim 2, wherein said predicting means predicts the actuations of plural thermal energy generating elements for plural line recording on the basis of the recording signals for the plural lines supplied from the line buffers.

4. An apparatus according to claim 3, wherein said predicting means weights the recording signals.

5. An apparatus according to claim 1, wherein said control means effects preliminary actuation of said thermal energy generating elements prior to actuation responsive to the recording signal.

6. An apparatus according to claim 1, wherein said thermal energy generating element is actuated in accordance with an ejection signal responsive to the recording signal.

7. An apparatus according to claim 6, wherein the ejection signal includes a sub-heat pulse not resulting in ejection of the ink and a main heat pulse for ejecting the ink, with a rest period therebetween.

8. An apparatus according to claim 7, wherein the rest period is changed in accordance with an output of said detecting mans.

9. An apparatus according to claim 7, wherein the sub-heat pulse is changed in accordance with an output of said detecting means.

10. An apparatus according to claim 1, wherein said thermal energy generating element causes a change of state of the ink by heat produced thereby to eject a droplet of the ink.

11. An apparatus according to claim 10, wherein the state of change is formation of a bubble by film boiling.

12. An apparatus according to claim 1, wherein said recording head is a full-line recording head having ejection outlets covering an entire recording width.

13. An apparatus according to claim 1, wherein said recording head comprises plural recording head elements.

14. A liquid jet recording apparatus comprising:

a recording head having plural ejection outlets for ejecting ink, liquid passages for containing the ink and communicating with said ejection outlets, respectively, and thermal energy generating elements for applying head to the ink to produce bubbles, provided for the respective liquid passages, the ink being characterized by a viscosity and a critical ejection viscosity;

discriminating means for analyzing a record signal to be applied during recording to said thermal energy generating elements of said recording head;

control means, responsive to said discriminating means, for applying a signal, other than the record signal, to one of said thermal energy generating elements for which a predetermined heat generating is not effected for a predetermined period, within a limit not producing the bubble to preliminary heat the ink to decrease the viscosity of the ink lower than the critical ejection viscosity.

15. An apparatus according to claim 14, wherein when the thermal generating element is to receive the other signal by said control means, and when the record signal is also to be applied to the same thermal energy generating element, the thermal energy generating element first receives the other signal from said control means.

16. An apparatus according to claim 14, wherein said thermal energy generating element causes a change of state of the ink by heat produced thereby to eject droplets of the ink.

17. An apparatus according to claim 16, wherein the state of change is formation of the bubbles by film boiling.

18. An apparatus according to claim 14, wherein said recording head is a full-line recording head having the ejection outlets covering an entire recording width.

19. An apparatus according to claim 14, wherein said recording head comprises plural recording head elements.

20. A recording method using an ink jet recording head having plural ejection outlets for ejecting ink and thermal energy generating elements provided for the respective ejection outlets to apply heat to the ink, the ink being characterized by a viscosity and a viscosity ejection viscosity, said method comprising the steps of:

determining whether each of said thermal energy generating elements will be actuated for a predetermined period on the basis of record signals supplied to said thermal energy generating elements of said recording head;

effecting preliminary heating by actuation of one of said thermal energy generating elements to decrease the viscosity of the ink lower than the critical ejection viscosity, when in said determining step it is determined that the one thermal energy generating element is not actuated to a predetermined degree in the predetermined period; and effecting main heating after said pre-heating step, for actuating the one thermal energy generating element to effect recording in accordance with the record signal.

21. A method according to claim 20, wherein said determining step includes determining whether the heat generating elements will be actuated in plural record lines, in accordance with the record signals for the plural record lines.

22. A method according to claim 21, wherein in said determining step the record signals for plural record lines are weighted, and it is determined whether the heat generating elements will be actuated for the plural lines.

23. A method according to claim 20, wherein said thermal energy generating elements are actuated n accordance with ejection signals responsive to the record signals.

24. A method according to claim 23, wherein each ejection signal includes a sub-heat pulse not resulting in ejection of the ink and a main heat pulse for ejecting the ink, with a rest period therebetween.

25. A method according to claim 24, wherein each rest period is changed in accordance with a determination in said detecting step.

26. A method according to claim 24, wherein each sub-heat pulse is changed in accordance with a determination said detecting step.

27. A method according to claim 20, wherein each thermal energy generating element causes a change of state of the ink by heat produced thereby to eject a droplet of the ink.

28. A method according to claim 27, wherein the state of change is formation of a bubble by film boiling.

29. A method according to claim 20, wherein said recording head is a full-line recording head having ejection outlets covering an entire recording width.

30. A method according to claim 20, wherein said recording head comprises plural recording head elements.

31. An apparatus according to claim 1, wherein said predicting means predicts heat accumulation X in said thermal energy generating elements by integration of the recording signals influential to a particular thermal energy generating element using the formula:

$$X = \sum_i a_i t_i$$

where i is a suffix representative of recording signals influential to the particular thermal energy generating element, $t_i$ is a quantity of generated heat of the influential recording signals, and $a_i$ is a temperature coefficient corresponding to the particular thermal generating element.

* * * * *

UNITED STATES PATENT AND TRADEMARK OFFICE

CERTIFICATE OF CORRECTION

PATENT NO. : 5,300,969 Page 1 of 3

DATED : April 5, 1994

INVENTOR(S) : Miura, et al.

It is certified that error appears in the above-indentified patent and that said Letters Patent is hereby corrected as shown below:

On title page, item

[56] REFERENCES CITED - FOREIGN PATENT DOCUMENTS:

"60-248357 5/1984 Japan ." should read --60-248357 12/1985 Japan .--.

COLUMN 2:

Line 12, "case" should read --cases--;
Line 44, "and," should read --and--.

COLUMN 3:

Line 51, "of" should be deleted;
Line 53, "block," should read --block--.

COLUMN 4:

Line 60, "determines" should read --determines the--, and "analyzing" should be deleted;
Line 61, "of" should read --of analyzing--.

COLUMN 5:

Line 40, "represents" should read --represent--;
Line 48, "cases c" should read --cases--.
Line 51, "printings" should read --of printing--.

UNITED STATES PATENT AND TRADEMARK OFFICE

CERTIFICATE OF CORRECTION

PATENT NO. : 5,300,969 Page 2 of 3

DATED : April 5, 1994

INVENTOR(S) : Miura, et al.

It is certified that error appears in the above-indentified patent and that said Letters Patent is hereby corrected as shown below:

COLUMN 6:

Line 19, "of the" should read --of the ink--;
Line 23, "In" should be deleted;
Line 43, "FIG. 7(E)" should read --FIG. 7(C)--.

Figure 10A:
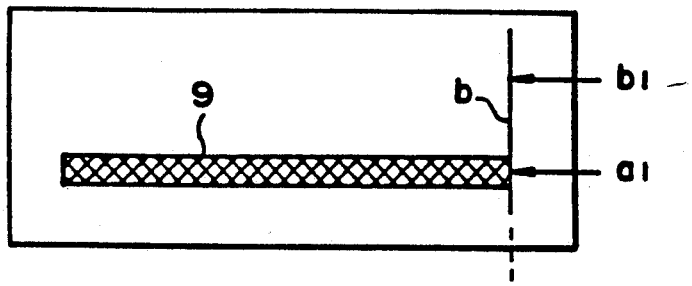
FIGS. 10(A)–(E) are graphs showing an example of pre-heating operation.
Figure 10B:
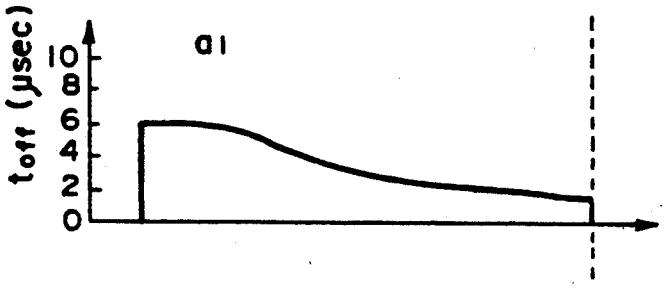
Figure 10C:
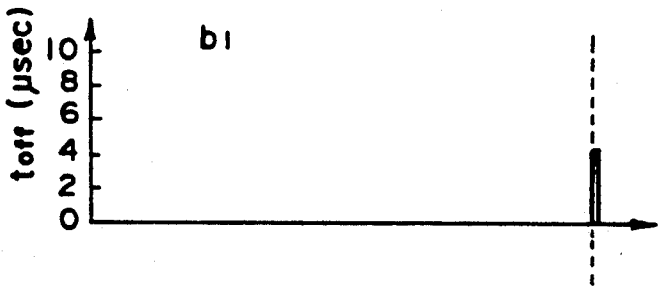
Figure 10D:
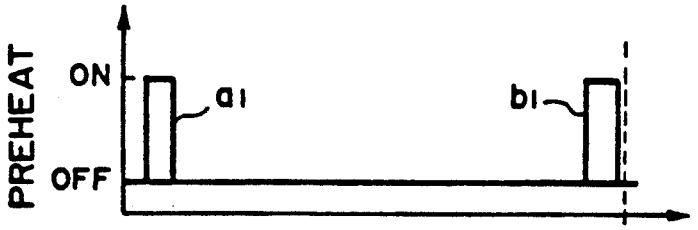
Figure 10E:
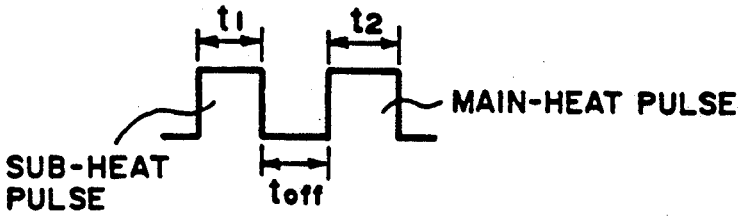

COLUMN 7:

Line 54, "FIG. 1(E)." should read --FIG. 10(E).--.

COLUMN 9:

Line 42, "applied the" should read --applied. The--.

COLUMN 10:

Line 12, "head" should read --heat--;
Line 25, "preliminary" should read --preliminarily--;
Line 30, "buffer" should read --buffers--;
Line 53, "mans." should read --means.--.

UNITED STATES PATENT AND TRADEMARK OFFICE

CERTIFICATE OF CORRECTION

PATENT NO. : 5,300,969 Page 3 of 3

DATED : April 5, 1994

INVENTOR(S) : Miura, et al.

It is certified that error appears in the above-indentified patent and that said Letters Patent is hereby corrected as shown below:

COLUMN 11:

Line 6, "head" should read --heat--;
Line 19, "nary" should read --narily--;
Line 22, "thermal" should read --thermal energy--;
Line 47, "viscosity" (second occurrence) should read --critical--.

COLUMN 12:

Line 18, "n" should read --in--;
Line 30, "nation" should read --nation in--.

Signed and Sealed this

Twenty-ninth Day of November, 1994

*Attest:*

Bruce Lehman

BRUCE LEHMAN

*Attesting Officer*

*Commissioner of Patents and Trademarks*